United States Patent [19]

Niske

[11] Patent Number: 4,645,484

[45] Date of Patent: Feb. 24, 1987

[54] METHOD FOR THINNING REGIONS OF PACKING MATERIAL TO FACILITATE PACKAGE ASSEMBLAGE

[75] Inventor: Jörgen Niske, Lund, Sweden

[73] Assignee: Tetra Pak International AB, Lund, Sweden

[21] Appl. No.: 793,324

[22] Filed: Oct. 29, 1985

[30] Foreign Application Priority Data

Nov. 5, 1984 [SE] Sweden ..... 8405539

[51] Int. Cl.[4] ..... B31B 1/25

[52] U.S. Cl. ..... 493/362; 493/370; 493/467; 51/74 R; 51/326

[58] Field of Search ..... 493/340, 342, 354, 361, 493/362, 369, 370, 371, 467, 60, 64; 51/74 R, 329

[56] References Cited

U.S. PATENT DOCUMENTS

| | | | |
|---|---|---|---|
| 2,542,298 | 2/1951 | Zinn, Jr. | 493/64 |
| 2,982,186 | 5/1961 | McKeen | 493/362 |
| 3,010,260 | 11/1961 | Subklew | 493/370 |
| 3,073,216 | 1/1963 | Gaunt | 493/340 |
| 3,074,327 | 1/1963 | Grahn | 493/352 |
| 3,179,025 | 4/1965 | Schur | 493/362 |
| 3,408,776 | 11/1968 | Kalwaites | 493/369 |
| 3,779,786 | 12/1973 | Tone | 493/370 |
| 3,780,626 | 12/1973 | Hollier, Jr. | 493/467 |
| 3,854,249 | 12/1974 | Fletcher | 493/370 |
| 4,540,391 | 9/1985 | Fries, Jr. | 493/287 |

*Primary Examiner*—Frederick R. Schmidt
*Assistant Examiner*—William E. Terrell
*Attorney, Agent, or Firm*—Burns, Doane, Swecker & Mathis

[57] ABSTRACT

A method for thinning a web along selected regions of a blank or a web of a material having at least one layer of paper or cardboard by passing the material over one or more die rolls, each being provided with raised portions which bring the material into contact with a rapidly rotating grinding wheel which grinds which selected surfaces of the material away.

8 Claims, 6 Drawing Figures

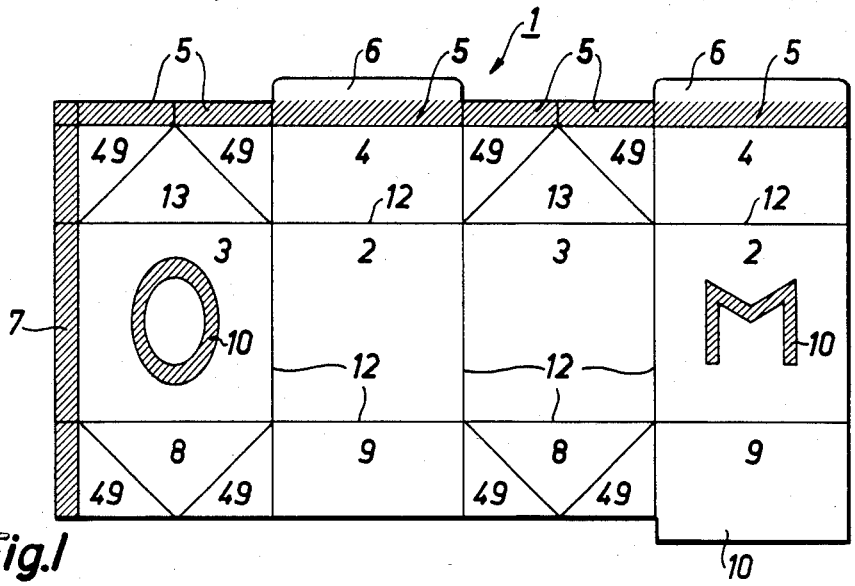
Fig.1
Fig. 2
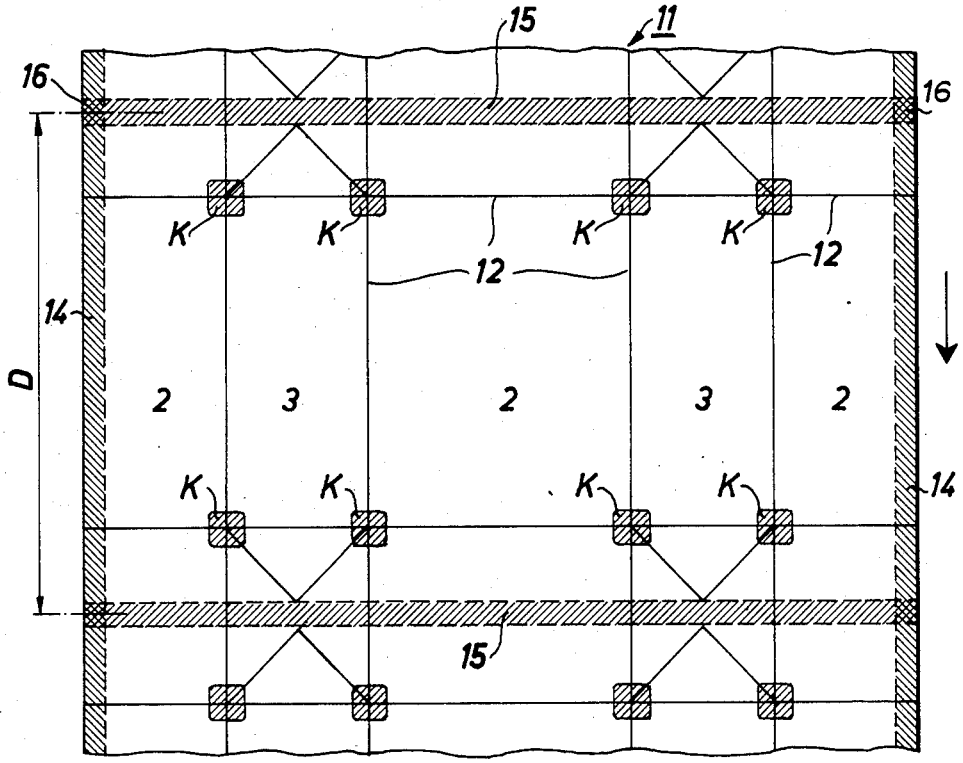

METHOD FOR THINNING REGIONS OF PACKING MATERIAL TO FACILITATE PACKAGE ASSEMBLAGE

FIELD OF THE INVENTION

The present invention relates to methods for thinning selected regions of a web having at least one layer of paper or cardboard for the purpose of obtaining visible markings or of facilitating the shaping of the web and/or improving the conditions for manufacturing packages with tight sealing joints from the material.

BACKGROUND OF THE INVENTION

In packaging technique, packages of the non-returnable type have been is use for a long time which are manufactured from a material which consists of a carrier layer of cardboard or paper and outer and inner coatings of thermoplastics. Frequently the packing material in such packages is also provided with additional layers of other material, e.g. aluminium foil or plastic layers other than those mentioned.

The composition of the packing material is intended to create the optimum product protection for the goods which are to be packed, and to impart sufficient mechanical protection for the product in the package and adapting it so that it can be readily handled by the user of the package. In order to achieve mechanical rigidity so as to provide mechanical protection for the contents and make it possible for the package to be of such rigid form that it can be handled and gripped by hand without difficulty, the packages of this type are often provided with a carrier layer of paper or cardboard which gives the package rigidity of form and affords mechanical protection. Such a carrier layer, however, is permeable to gases or liquids and the rigidity of the material disappears if the material is subjected to moisture or if liquid is absorbed into the material. To make the material satisfactorily impermeable to liquids, it is most frequently laminated with a plastic material, and if this plastic material is thermoplastic, the plastic layers can be sealed to each other with the help of heat and pressure. In this manner, the packaging container can be sealed and given permanent form by the sealing of overlapping, plastic coated material panels to each other in a tight and mechanically durable and strong seal.

Packing containers of the type referred to here are manufactured either from blanks punched out beforehand or from a continuous web which has been prepared with suitable decoration and with a crease line pattern facilitating the folding. The packing containers are manufactured from such a web by joining together the longitudinal edges of the web in an overlap joint so as to form a tube which is subsequently filled with the intended contents and divided into closed container units by means of repeated transverse sealing of the tube perpendicularly to the longitudinal axis of the tube. After suitable folding of the packing material in the tube the material in the said container units is converted to the desired geometrical shape, usually a parallelepiped, by providing the tube with longitudinal folding lines and with double-walled triangular lugs at the corners of the packing container.

Whether the packing containers are manufactured from blanks produced beforehand or from a continuous web, the material, for practical reasons, will be of uniform thickness and in order to make it possible to achieve the desired rigidity of form the paper or cardboard layer is relatively thick in relation to the remaining layers included in the laminate. This means that the combined layers which are produced in the forming and sealing of the package bring about appreciable local thickenings and that leakage problems may arise at the transitions between one portion with multiple material thickness and one with single material thickness. Such leakage problems are accentuated especially at intersections between joints where each joint region presents double or multiple material thickness. At such intersections which in general are usually called "crosses", leakage channels can easily occur which may cause slight liquid leakage or which in aseptic packages may cause infection of the sterile contents of the package.

OBJECT AND SUMMARY OF THE INVENTION

With the objective of overcoming the aforementioned disadvantages, the packing material and, more particularly, its base layer which mainly determines the thickness can be thinned within the regions where the material is overlapped into multi-layered portions such as at joints. Such thinning presupposes a local machining of selected portions of the material, e.g. by grinding, which previously has proven to be difficult, but which by the method described in the following is capable of being applied on an industrial scale.

The present invention provides a method for thinning a web along selected regions by passing the web or blank between one or more pairs of rolls, which pairs include a die roll and a grinding roll. The die roll has a pattern of raised portions for urging the web against the grinding wheel according to the selected regions. In order to accurately grind along the selected regions without forming burrs, two pairs of rolls are employed whose grinding rolls rotate in opposite directions and whose die rolls have complementary patterns which cause the grinding effected by one pair of rolls to overlap the grinding effected by the other pair of rolls along the selected regions.

BRIEF DESCRIPTION OF THE DRAWING

The invention will be described in the following with reference to the attached schematic drawing, wherein:

FIG. 1 is a web blank for a packing container with regions which have been thinned according to the present invention;

FIG. 2 is a continuous web of packing material provided with crease lines which facilitate the forming of the packing material;

DETAILED DESCRIPTION OF THE PREFERRED EMBODIMENTS

Figure 3:
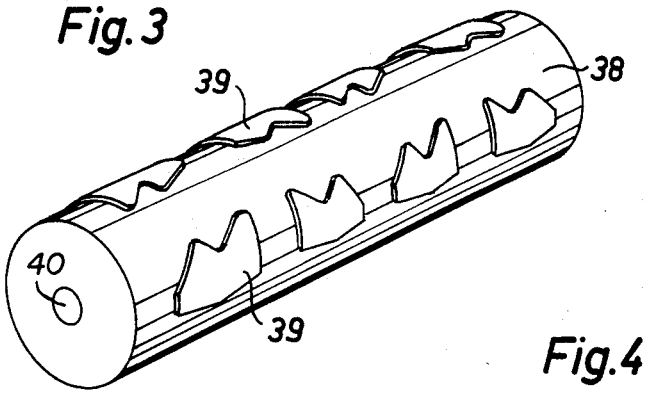
FIG. 3 is a roll for performing the present invention.

In FIG. 1 is shown an original blank for a packing container. This blank has been punched out of a sheet or a web of cardboard material of constant thickness and the blank is designated 1 in the Figure. The blank 1 is divided by a pattern of crease lines 12 into side wall panels or spaces 2 and 3, top closure panels 4 and 13 and bottom sealing panels 8 and 9. The top sealing panels 13 and bottom sealing panels 8 are triangular and are arranged so as to be folded in a bellowslike manner in between the top closure panels 4 and the bottom sealing panels 9 respectively. As the triangular panels 13 and 8 are folded in this way the adjoining panels 49 are folded back in such a manner that they come to lie between panels 4 and 13 and panels 9 and 8 respectively. This top and bottom design is found generally on so-called "gable-top" packages.

In principle the blank 1 is converted to a package by being formed first to a tube of square or rectangular cross-section and by the short sides of the blank 1 being joined together in that the longitudinal joint panel 7 is combined in an overlap joint with the corresponding short side of the blank 1. After the blank has been formed to a tube of square or rectangular cross-section it is threaded onto a mandrel in a packing machine not shown in the drawing. Whilst the tubelike blank is on the mandrel the bottom wall panels 8 and 9 are folded in over each other in the manner indicated above whereupon the bottom panels are sealed to one another in that the thermoplastic coatings of portions lying against each other are made to fuse together through the application of heat and pressure. To stabilize the bottom seal one of the bottom wall panels 9 is provided with a sealing lug 10 which during the bottom sealing will overlap the outer edge of the outer bottom wall panel 9.

When the bottom seal has been completed the container formed is drawn off the mandrel and filled with the intended contents whereupon the top is closed by flapping down the top closure panels 13 and 4 over the opening of the container with the triangular panels 13 located in between the outer rectangular panels 4. When this top panel folding is carried out the sealing panels 5 will be collected side by side in a sealing fin comprising four material layers. By compressing these sealing panels while supplying heat the thermoplastic coatings provided on the surfaces of the panels are made to melt and are combined with each other so as to form a liquid-tight and durable sealing joint. The top sealing panels 6 adjoining the rectangular panels 4 will also be joined to one another in a sealing joint which will lie above the sealing joint 5.

As mentioned above the finished package comprises a number of portions where several material layers are placed together and where the risk of "channel formation" at the transition between regions of different thickness exists. The regions primarily concerned are the sealing regions at the top and bottom of the package and the crossing points between the longitudinal overlap joints where longitudinal edges of the blank are joined to each other and to the top and bottom seals.

As can be seen in FIG. 1 certain portions of the package blank have been hatched, and these are the portions which are thinned so as to obtain a tighter and better seal. Naturally the "grinding pattern", that is to say the parts which are thinned by grinding, can be varied according to individual requirement and the appearance and design of the packing container and the grinding pattern shown in FIG. 1 is only meant to represent a possible example. It is also feasible to give the different portions which are to be ground different thicknesses, that is to say work off different amounts of material and it is even conceivable to vary the grinding thickness within one and the same grinding region.

In the present case which is shown in FIG. 1 primarily those surfaces are machined and thinned where several material layers are sealed to one another, that is to say the regions 5, 7, so as to compensate for the effects which are produced when a number of material layers are sealed to one another. The grinding of patterns can also be utilized in order to produce in the packing material a relief-like pattern 10 of an ornamental or advertising character.

After the grinding procedure, the execution of which will be described later, the ground material surfaces are coated with a thermoplastic coating which imparts to the material a protective cover against external moisture which otherwise might be absorbed and damage the base layer of the packing material.

As mentioned previously the material may also be constituted of a continuous web 11 which is shown in FIG. 2. As pointed out in the introduction, the packages are manufactured from such a web by converting the web first to a tube in that the longitudinal edges 14 of the web 10 are joined to one another whereupon the tube is filled with the intended contents and divided up into individual packing containers by transverse sealing of the filled tube, shaping of the package and finally separation of the packing containers by cutting through the transverse sealing zones.

A packing material web 11 of the type referred to here (FIG. 2), like the blanks 1 dealt with earlier, is provided with a crease line pattern to facilitate the forming of the package by folding, and for the sake of greater clarity the same reference numerals have been used for corresponding parts of the blanks 1 and the web 11. One outer edge 14 of the web is intended to be made to overlap the opposite web edge 14 in a longitudinal sealing joint and for this reason the combined width of the outer panels 2 is somewhat greater than the width of the central panel 2. A full package length is designated D and as is evident from the Figure there is a region 15 between complete decorations or crease line patterns of one package unit which is a common sealing region for successive packages. The final separation of the packages takes place by means of a cut through this sealing zone that is to say within the regions of the corresponding panel 15. As in the case of the blank according to FIG. 1, the thinned portions in FIG. 2 are shown hatched and in this case, as shown, the portions 14, which form a longitudinal joint on the tube mentioned previously which is converted to packing containers, have been thinned at least in the regions 16 where a crossing with transverse joint panels is formed. In order to reduce the whole longitudinal joint to the same thickness as the remaining parts of the package wall the whole longitudinal joint area 14 can be thinned. Moreover, in this particular case a region where several folding lines or crease lines converge (e.g. the region marked K) has been subjected to thinning. The reason for this is that especially in these regions the packing material is subjected to great tensile stresses since the material is doubled in several layers. These so-called K-crease stresses become greater the thicker the material and these stresses consequently can be reduced through a thinning in the K-crease regions.

As shown in FIG. 2 the crease lines 12 facilitating the folding can also be ground which means that material is removed in the crease line region instead of the fibres in the cardboard or paper material being crushed and a permanent deformation along the crease line pattern being created. Ground crease lines can be realized in such a manner that the folding is facilitated considerably compared with conventional crease lines, but involves a certain weakening of the material.

Figure 4:
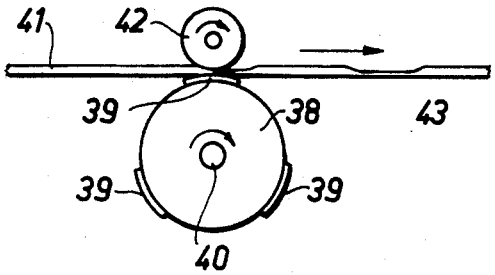
FIG. 4 is an arrangement for the carrying out of the grinding operation, of the present invention.

The realization of the grinding or milling operation may take place with the help of auxiliary means described in the following and methods which are described with reference to FIGS. 3 and 4. One such method especially suitable for this purpose consists in that the web or the sheets 41 which are to be machined and locally thinned are passed over a roll 38 (die roll) which rotates with the web around an axle 40. As is evident from FIGS. 3 and 4 raised portions or dies 39 are located on the surface of the die roll 38 which are of a shape and dimension corresponding to the shape of the thinned regions desired. Similarly the mutual placing of the dies 39 on the roll 38 is adapted so that it corresponds to the mutual placing of the ground regions desired on the blank or the web 41 respectively.

Adjoining the roll 38 is arranged a rapidly rotating grinding wheel or milling wheel 42 which preferably is made to rotate against the direction of feed of the material but which may also rotate in the opposite direction (depending upon the design of the grinding wheel). The distance between the surface of the roll 38 and the working edge "or working surface" of the grinding wheel 42 is adjusted until it corresponds to, or slightly exceeds, the normal total thickness of the packing material 41 which means that the material can pass under the grinding wheel 42 without being affected by the same. On rotation of the roll 38 which takes place synchronously with the feed of the material web 41 the raised portions or dies 39 on the die roll 38 will press the web 41 against the grinding wheel 42, and the material will be ground away within the portions of the web 41 which are acted upon by the dies 39. Through adaptation of the thickness of the dies 39 the depth of grinding in the material can be accurately determined. It has been found that the grinding produces a well-defined ground surface except that a transition zone will always be formed between material with full grinding depth and full material thickness. One phenomenon which has been observed is that the grinding edge becomes uneven and shows "edge burrs" if the direction of rotation of the grinding wheel is opposite to that of the material web and the grinding wheel releases contact with the material along a line which runs parallel with the axle of the grinding wheel 42. In order to avoid this disadvantage the rear edge lines in the direction of feed of the grinding regions either have to be adapted so that they form an angle with the axis of rotation of the grinding wheel or else the grinding regions have to be designed in such a manner that their rear edge is terminated in a point which means that the grinding wheel 42 gradually relinquishes contact with the grinding region finally to lose contact completely with the material 41. Providing the grinding is carried out in this manner a relatively uniform and clean-edged grinding will be achieved.

Figure 5:
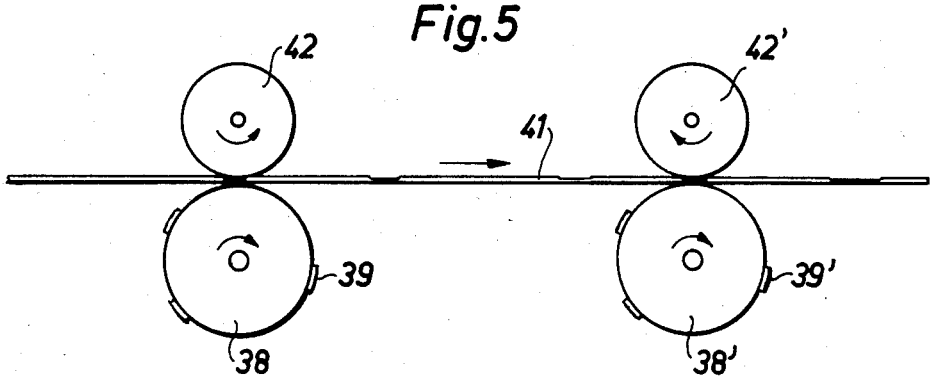
FIG. 5 is an arrangement in accordance with FIG. 4, but having double grinding rolls.

However, the problem of edge burrs or fins can be solved in another and more elegant manner by making use of a double grinding equipment with contra-rotating grinding rolls as shown in FIG. 5.

Figure 6:
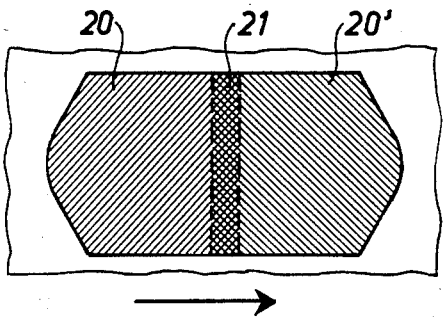
FIG. 6 is a web having a region which has been "double-ground".

The grinding equipment shown in FIG. 5 comprises two die rolls 38 and 38' which on their surface are provided with dies 39 and 39' projecting from the surfaces of the die rolls 38 and 38'. For each of the die rolls 38 and 38' a grinding roller 42 and 42' respectively is provided and as is evident from the arrows which mark the direction of rotation of the rolls the die rolls 38 and 38' have the same direction of rotation whilst the grinding rolls 42 and 42' have opposite direction of rotation. The web intended for machining which is guided between die rolls and grinding rolls is designated 41 as in the previous case. In FIG. 6 is shown a grinding region which consists of two regions partially overlapping each other which are designated 20 and 20'. On carrying out the grinding operation with an arrangement according to FIG. 5 the region 20 is ground by means of the first grinding roll 42 whereas the second region 20' is ground with the help of the grinding roll 42' and, as can be seen from FIG. 6, there is an overlap region 21 between the regions 20 and 20' which is machined by both grinding rolls 42 and 42'. To achieve such a double grinding of a region the die rolls 38 and 38' have to be driven completely synchronously and this can be done with the help of a gear set or a chain drive. Moreover, the dies 39 and 39' must be located so on the respective die rolls 38 and 38' that the dies will engage with the web 41 in such a way that the overlap pattern which is shown in FIG. 6 is achieved. This adjustment of the position of the dies on the die rolls is relatively easy to carry out and once it has been adjusted the position in relation to the web is not altered owing to the die rolls 38 and 38' being driven synchronously.

The reason why it is desirable to use a double grinding in accordance with the abovementioned method and design is that the grinding rolls 42 and 42' leave a roughened edge or so-called grinding burr along the edge line where the working surface of the grinding rolls 42 and 42' leaves the material. Thus the grinding roll 42 leaves a grinding burr along the edge of the ground region which is the front edge in the direction of feed of the material web 41, and the grinding roll 42' leaves a grinding burr along the rear edge of the ground region which is produced. By carrying out the grinding operation of a grinding region as two partial grindings overlapping each other the said disadvantage can be overcome, since the grinding burr which would have been formed on the two regions would be situated within the overlap zone 21 which, however, is machined by both grinding rolls and does not, therefore, present any grinding burr.

By using the arrangement in accordance with FIG. 5 with two contra-rotating grinding rolls 42 and 42' it is possible to grind fine details without on account of this any grinding burr being produced. As mentioned earlier the grinding method which has been described can also be used for producing the crease line pattern 12 and it has proved advantageous here to bring this about with the help of a double grinding. Especially the oblique or converging crease lines in the crease line pattern can be produced with great accuracy with the help of the grinding procedure. It is also very appropriate to use the double grinding procedure in accordance with FIG. 5 when it is intended to grind a relief-like ornamental pattern (10 in FIG. 1) into the packing material and it is possible with the help of the arrangement to grind very fine details in an ornamental pattern and of course also in a grinding pattern which has a purely technical function. As mentioned previously, a graded depth of grinding can be produced in any grinding region by designing the dies 39 in an appropriate manner and this possibility can be utilized not least when it is intended to produce a relief-like ornamental pattern but it also can be applied in thickness-reduction of grinding regions with the purely technical objective of achieving an optimum effect of the grinding by means of a graded depth of grinding. The scope of application of the invention is not confined to the technique of packaging even though the embodiments which have been described are associated with packaging. It is also possible e.g. to apply the invention to produce relief-like patterns on notepaper, securities, identity deeds etc. so as to achieve a decorative effect or a check of identity for the purpose of security.

The description given here has as its purpose only to indicate the preferred embodiments of the invention and it is possible within the scope of the concept of the invention to find a number of other embodiments or fields of application where packages or packing material should or must be thinned locally so as to allow a certain technical effect or ornamental effect to be achieved.

Accordingly, it is to be understood that the present invention may be embodied in other specific forms without departing from the spirit or essential characteristics of the present invention. The preferred embodiments are therefore to be considered illustrative and not restrictive. The scope of the invention is indicated by the appended claims rather than by the foregoing descriptions and all changes or variations which fall within the meaning and range of the claims are therefore intended to be embraced therein.

What is claimed is:

1. A method for thinning a web along selected surface regions on the web, said web having a predetermined thickness and at least one layer of paper material, said method comprising the steps of feeding the web at a feed speed between at least two pairs of cooperating rolls, each pair including a die roll and a grinding roll, rotating the die rolls at a speed corresponding with said feed speed providing contact between said die rolls and said web without sliding therebetween and rotating said grinding rolls at a speed greater than said feed speed, the grinding roll of the first pair of cooperating rolls rotating in a first direction and the grinding roll of the second pair of cooperating rolls rotating in a second direction opposite said first direction, each of said die rolls having a cylindrical surface and local raised portions which extend radially outwardly from the cylindrical surface of the die rolls, said die and grinding rolls of each of said pair being spaced apart so that a distance between the cylindrical surface of the die rolls and the working surfaces of the grinding rolls at least equals the predetermined thickness of the web and a distance between the working surfaces of said grinding rolls and said raised portions of the die rolls is less than the predetermined thickness of the web, whereby as the web passes over the die rolls, the web is pressed locally by said raised portions on the die rolls against the grinding rolls so that portions of the material are removed to form the thinned surface regions on the web.

2. The method in accordance with claim 1, wherein the raised portions of the die rolls are arranged in a pattern corresponding with a desired pattern of selected surface regions on the web and that the distance between the working surface of the grinding rolls and the projecting portions of the die rolls corresponds with a desired thickness of the material to remain beneath the selected surface regions.

3. The method in accordance with claim 1, further comprising the step of guiding the web in a longitudinal direction and in a transverse direction so that the surface regions of the web intended to be thinned will be urged against said raised portions of the die rolls.

4. The method in accordance with claim 1 wherein, the die rolls of the two pairs of rolls rotate synchronously with each other, said method including the steps of partially thinning the selected surface regions with the first one of said pairs of rolls and partially thinning the selected surface regions with the second one of said pairs of rolls so that the desired total degree of thinning of the selected surface regions is obtained by cooperation of the two pairs of rolls.

5. A method in accordance with claim 1, wherein forward portions of the selected surface regions with respect to the direction of feed of the web are ground by the grinding roll whose direction of rotation is opposite to the direction of feed of the web and rearward portions of the selected surface regions with respect to the direction of feed of the web are machined by the grinding roll whose direction of rotation corresponds with the direction of feed of the web.

6. The method in accordance with claim 1, wherein the thinned surface regions coincide with folding and sealing zones along the web.

7. The method in accordance with claim 1, wherein the thinned surface regions include visually detectable markings.

8. A method for thinning preselected surface regions of a web according to a predetermined pattern comprising the steps of:

feeding the web between a first rotating die roll having first raised surface portions generally corresponding with said predetermined pattern and a grinding roll, said raised surface portions urging said web against said first grinding roll which thins first surface zones on said web which overlap said preselected surface region; and feeding the web between a second rotating die roll having second raised surface portions generally corresponding with said predetermined pattern and a second rotating grinding roll, while synchronizing the rotation of the first and second die rolls and while rotating the second grinding roll oppositely with respect to said first grinding roll, said second raised portions urging said web against said grinding roll which thins second surface zones on said web which overlap said first surface zones along said preselected surface regions.

* * * * *